United States Patent [19]

Gerwin

[11] Patent Number: 4,557,210

[45] Date of Patent: Dec. 10, 1985

[54] TWIN HULL DISASSEMBLABLE ROWBOAT

[75] Inventor: Jeffrey A. Gerwin, Gerwin Marine Company, Inc., 150 E. 58th St., New York, N.Y. 10155

[73] Assignee: Jeffrey A. Gerwin, New York, N.Y.

[21] Appl. No.: 595,427

[22] Filed: Mar. 30, 1984

[51] Int. Cl.[4] ..... B63B 5/24

[52] U.S. Cl. ..... 114/56; 114/61; 114/357

[58] Field of Search ..... 114/61, 357, 354, 56; 5/120, 127; 182/138, 139

[56] References Cited

U.S. PATENT DOCUMENTS

| | | | |
|---|---|---|---|
| 429,649 | 6/1890 | Schermerhorn | 114/61 |
| 1,794,417 | 3/1931 | Nador | 114/61 |
| 2,712,293 | 7/1955 | O'Higgins | 114/39 |
| 2,745,118 | 5/1956 | Potts et al. | 114/61 |
| 2,748,740 | 6/1956 | Villar | 114/61 |
| 2,916,748 | 12/1959 | Stahmer | 114/61 |
| 2,968,271 | 1/1961 | Bruvold | 114/61 |
| 3,061,845 | 11/1962 | Gerbracht | 114/344 |
| 3,179,960 | 4/1965 | Nimmo | 114/61 |
| 3,460,502 | 8/1969 | Carmichael | 114/61 |
| 3,473,502 | 10/1969 | Wittkamp | 114/39 |
| 3,760,439 | 9/1973 | Swenson, Jr. | 114/61 |
| 3,986,219 | 10/1976 | Michowski | 114/61 |
| 4,136,414 | 1/1979 | Popkin | 114/61 |
| 4,295,236 | 10/1981 | Upchurch | 114/357 |
| 4,406,239 | 9/1983 | Euzmann | 114/61 |

*Primary Examiner*—Sherman D. Basinger

*Attorney, Agent, or Firm*—Cullen, Sloman, Cantor, Grauer, Scott & Rutherford

[57] ABSTRACT

The twin hull rowboat includes certain structural and functional components designed to provide a water craft which, when assembled, is compact, easily rowed, highly maneuverable and has the stability characteristics of a catamaran. When the water craft is disassembled it can be easily stored in any motor yacht, sailboat or transported on the top of a vehicle or inside of a van or station wagon. Each hull is elongated and of unitary construction made from a plastic material. The outer skin of the hull is made from a tough or strong plastic such as polyethylene which surrounds an inner core of solid polyurethane foam material. A flexible deck is stretched between the hulls upon which the operator sits to row the boat. The hulls are held in rowing or assembled position by two round spars which slide into receptacles or sleeves molded directly into the top surface at the bow and stern of each hull. The spars and supports carry the flexible fabric deck. The ends of the spars are received in the bow and stern sleeves and are secured thereto by a quick release or removable pin type fastening device. The edges of the deck adjacent the hulls are secured thereto by removable tension members interposed between the deck and the hulls.

29 Claims, 9 Drawing Figures

TWIN HULL DISASSEMBLABLE ROWBOAT

BACKGROUND OF THE INVENTION

The present invention relates to rowboats and more particularly is concerned with a novel, lightweight, disassemblable water craft which can be assembled for use and taken apart for storage and transport.

A water craft or rowboat of the catamaran type is highly desirable due to its capacity and stability in the water. One of the undesirable features of such a craft lies in its cumbersome structure which renders transportation and storage very difficult. Nevertheless, the prior art does disclose knock down or collapsible catamaran type constructions of water crafts. However, they are not practical, particularly on larger units, or are incapable of withstanding the stresses and strains to which the craft may be subjected in rough water.

Boats have been made on the catamaran principal and have included a pair of floats or pontoons within a framework connecting the same above the level of the water. Collapsible but rigid frameworks and rigid decks have been used in combination with collapsible or telescoping pontoons so that the catamaran may be converted into a carried package when not in use. Usually, however, straps completely encircle the pontoons and have been provided to hold the pontoons to the framework and such straps have tended to be difficult to install and to offer considerable resistance to the passage of the pontoon through the water. Such rigid frames, decks and supports have thus at times detracted from the objectives, versatility and convenience of the water craft.

Therefore, the prior art water crafts, while having some of the same objectives and features of the present invention, have not proven successful in commercial use, are of complex components and structures and are expensive to manufacture and to operate efficiently.

SUMMARY OF THE INVENTION

The present invention involves a compact catamaran type rowboat or water craft. It provides a safe disassemblable unit which can be easily transported by automobile, station wagon or van when in a collapsed and packed condition. The water craft, when disassembled, can be easily stored in the "V" berths of any motor yacht or sailboat. When assembled, the catamaran type unit may be easily rowed, is highly manueverable in the water and has the stability characteristics of a conventional catamaran.

The present invention contemplates a twin hull disassemblable rowboat comprising a pair of generally identical elongated unitary buoyant hulls made from a plastic material, with the hulls being arranged and spaced side by side in parallel relation. The hulls are of novel construction, each having a bottom surface, a top surface and a pair of side surfaces.

A feature of the invention is that each hull is defined by a unitary elongated buoyant body having a longitudinal axis. The body is made from a plastic material and has a generally smooth and tough outer skin surrounding a foam plastic inner core. The top surface of each hull has a series of longitudinally spaced notches.

A further feature of the present invention includes a pair of tubular sleeves on each hull adjacent the bow and stern. With such a construction, the bow sleeve in one hull is transversly aligned with the bow sleeve in the other hull. In addition, the stern sleeve in one hull is transversly aligned in with the stern sleeve in the other hull.

Another feature of the present invention includes a flexible deck spanning the space between the hulls and having at one pair of edges, elongated tubular sleeves, and at the other pair of edges, a plurality of longitudinally spaced fastening eyelets corresponding generally to and being aligned with the notches in the opposing hull.

Still another feature of the present invention is that the hulls are held in rowing position by the provision of a pair of elongated spars extending through the corresponding tubular deck sleeves, with the ends of the spars extending beyond the deck sleeves and being respectively received in and carried by the pairs of aligned bow and stern sleeves located in the hulls.

In order to maintain the foregoing components in assembled relation, removable tension means are interposed between the eyelets of the flexible deck and the notches on the top surface of the hulls. In addition, removable pin fastening means extend through the bow and stern sleeves and the ends of the spars received therein to maintain the deck and the hulls in assembled relation.

The disassembly of the water craft or rowboat is carried out in the reverse order by removing the pin fastening means and the removable tension means as will become apparent by referring to the specification and drawings.

Other features of the invention relate to the size and configuration of the rowboat. Each plastic hull has a length of 6', a 2' height and a 1' width. The fabric deck has an area of approximately 5 square feet. When the flexible deck is assembled to the hulls, the water craft has a length of 6' and a compact width of approximately 5'. Each hull has one or more receptacles for the oar locks. The water craft has many unique and novel features which permit the unit to be assembled and disassembled easily and quickly. When assembled, it is sturdy and is extremely durable. It has certain positive floatation characterics as well as excellent stability characteristics. It is easily manueverable by one person sitting on the flexible deck and thus capable of being propelled through the water with reasonable ease.

It is thus a feature of the present invention to provide a water craft that offers complete collapsibility and which when disassembled provides a light weight, relative compact package that is readily stored and/or transported.

Another feature of the present invention provides a collapsable, lightweight water craft which can be handled, propelled and manuvered by one having only basic fundamental knowledge of the art of boating.

It is a further feature of the present invention to provide a knock down or disassemblable water craft or rowboat which can be assembled and disassembled by a single person without the use of tools in approximately thirty seconds or less.

BRIEF DESCRIPTION OF THE PATENT DRAWINGS

DESCRIPTION OF THE PREFERRED EMBODIMENT

Figure 2:
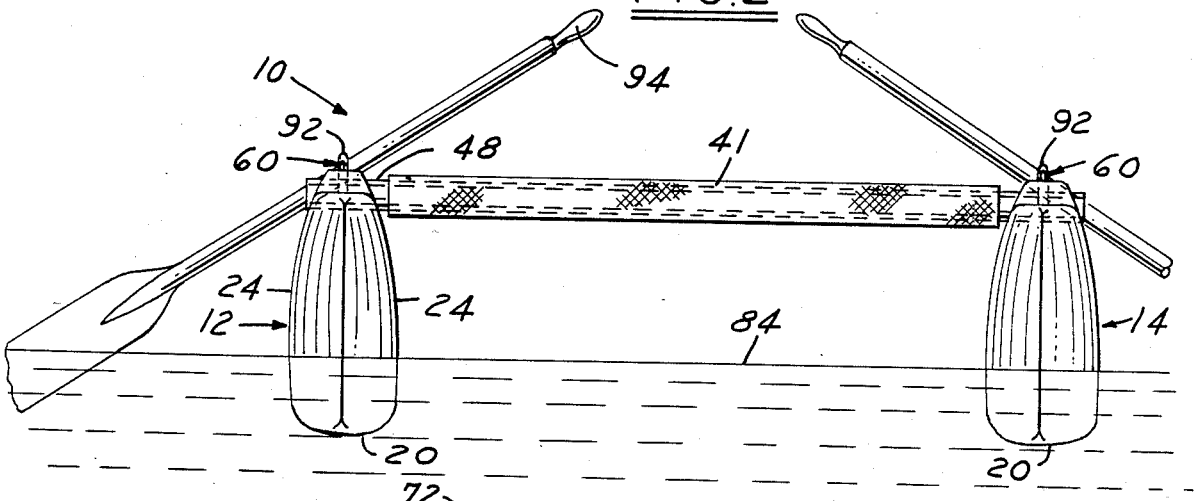
FIG. 2 is an end view of the rowboat looking in the direction of arrows 2—2 of FIG. 1.
Figure 3:
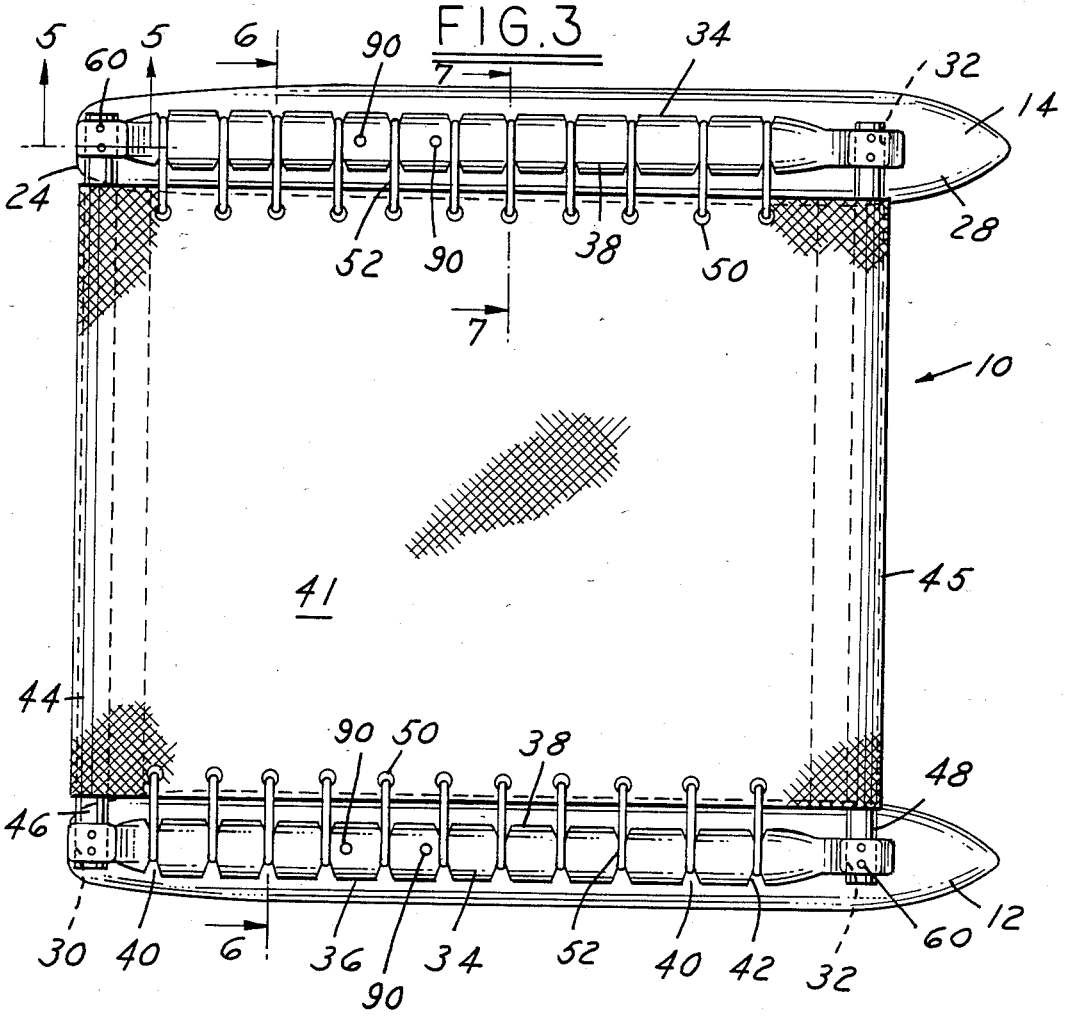
FIG. 3 is a top plan view of the rowboat illustrated in FIG. 1.
Figure 6:
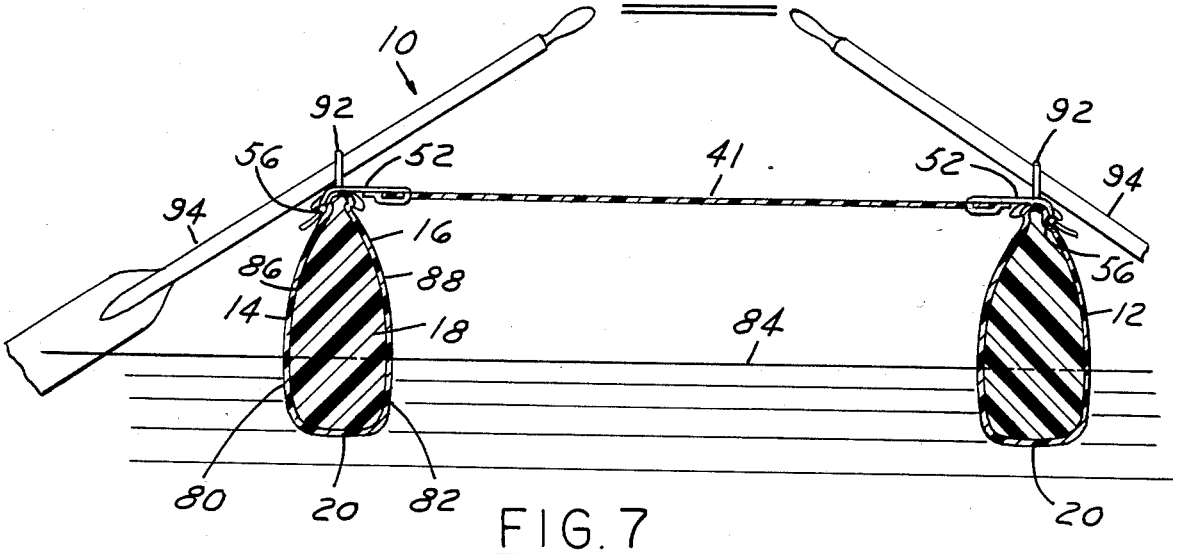
FIG. 6 is a sectional view taken on lines 6—6 of FIGS. 1 and 3.

Referring now to the drawings, the twin hull disassemblable rowboat or water craft of the catamaran type is designated by the numeral 10 in FIGS. 2, 3 and 6. The catamaran type rowboat 10 is characterized by its lightweight construction, utilizing a relatively few number of components, which permit the rowboat to be easily assembled for use and disassembled or taken apart expeditiously for storage and for transportation.

The rowboat or water craft 10 includes a pair of generally identical elongated unitary buoyant hulls 12 and 14. Each hull 12, 14 is made from a plastic material, with the hulls being arranged in spaced apart, side by side parallel relation, as illustrated in FIGS. 2 and 6.

Figure 1:
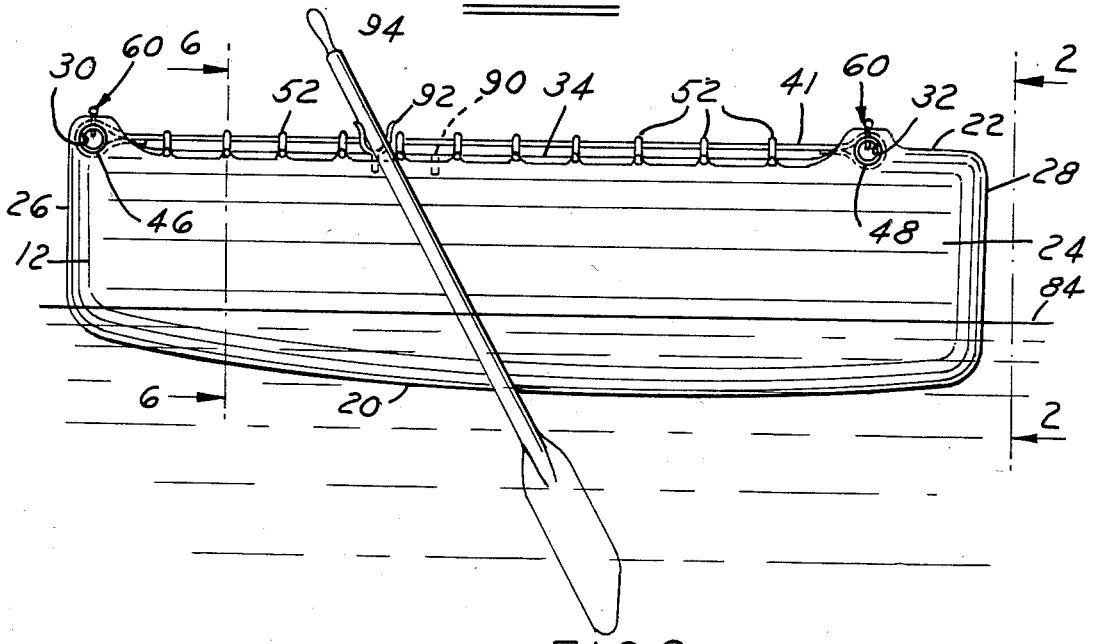
FIG. 1 is a side elevation of the rowboat of the catamaran type of the present invention.

Each hull, 12, 14 has a longitudinal axis and is of unitary construction. It has a body which is molded from a plastic material. It has a generally smooth and tough outer skin 16 made, as an example, made from polyethylene which surrounds a solid foam plastic inner core 18 made, as an example, from polyurethane foam. The body of each hull 12, 14 has a bottom surface 20, a top surface 22 and a pair of tapered side surfaces 24. The polyethylene skin is approximately 3/16" thick and forms an envelope which surrounds and encloses the solid polyurethane foam plastic core 18 located within the interior of the envelope defined by the outer skin 16. The plastic body of each hull is provided with end surfaces 26 and 28 which are curved or shaped as illustrated in the drawings and in particular in FIG. 3. In addition, the bottom surface 20, in elevation as shown in FIG. 1, has a generally curved configuration from the bow to the stern.

Figure 5:
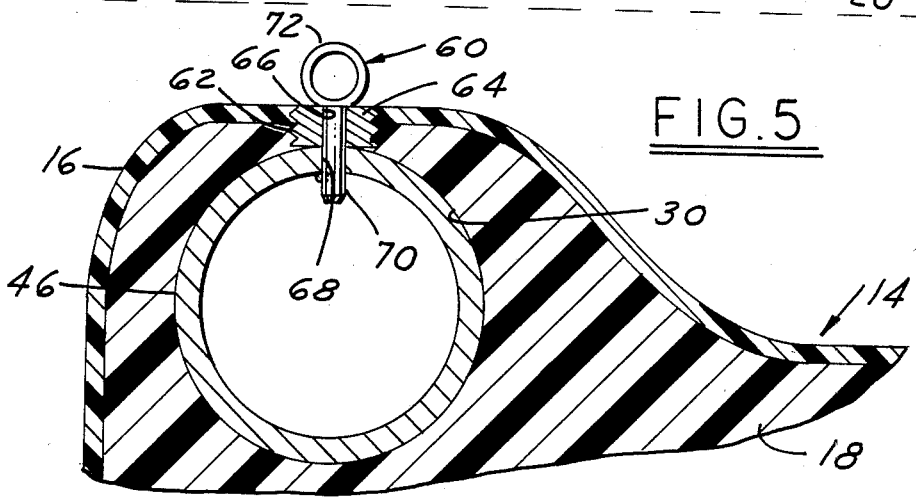
FIG. 5 is a fragmentary sectional view taken on the line 5—5 of FIG. 3 and illustrating the manner in which one or more removable pins connect the spar to the bow or stern sleeve of the hulls.
Figure 4:
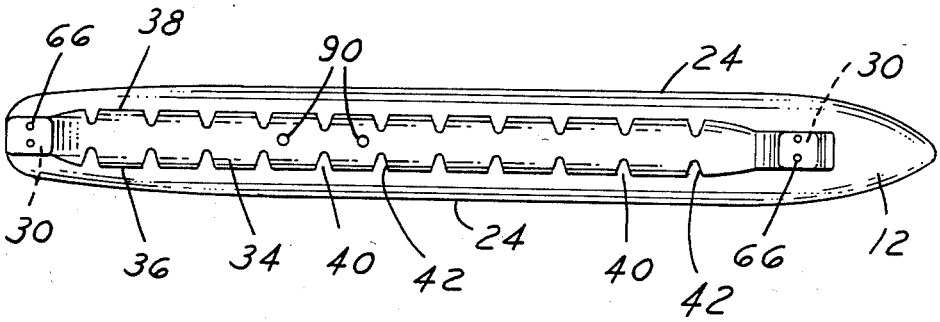
FIG. 4 is a top view of one of the hulls of the rowboat shown in FIGS. 1-3 inclusive.

Each hull, 12, 14 has a length of 6', a height of 2' and a width of 1' and 14 is provided with transversely extending openings 30 and 32 near the opposite ends thereof as shown in FIGS. 4 and 5. The openings 30 and 32 form a pair of integral tubular sleeves on each hull 12, 14 adjacent the bow and the stern thereof. At the time of assembly, the bow sleeve 32 in hull 12 is transversly aligned with the bow sleeve 32 in hull 4. On the other hand the stern sleeve 30 in hull 12 is transversly aligned with the stern sleeve 30 in hull 14.

The top surface 22 of each hull is provided with an upper rim 34 between the stern and bow sleeves 30 and 32 as shown in FIG. 3. The rim 34 is molded in the upper and outer surface of the floats or buoyant bodies of hulls 12, 14. The rims 34 extend longitudinally as illustrated in FIGS. 3 and 4. Each rim 34 has a pair of longitudinal edges 36 and 38. Each edge 36, 38 is provided with a plurality or a series of longitudinally spaced notches 40 having axes which extend generally perpendicular to the longitudinal axis of the hull. Each notch 40 has a pair of inwardly directed tapered side surfaces 42. Each pair of tapered surfaces at the inner ends thereof are spaced approximately 3/16" apart while the entrance to each notch 40 is spaced about ¼" apart. The tapered surfaces 42 are designed to hold and thereby retain the tension ropes in place as will be subsequently described.

The catamaran type rowboat 10 further includes a third major component in the form of a flexible deck 41 which is designed to span the space between the parallel hulls 12 and 14 when the rowboat 10 is assembled as illustrated in FIG. 3. The deck 41 is of generally rectangular configuration and has on the bow and stern ends or edges thereof elongated tubular sleeves 44 and 45. The sleeves 44, 45 are formed by rolling the deck edges over the adjacent material and sewing or securing the edges thereto. A pair of elongated spars, tubular rods or bars 46 and 48 extend through the elongated tubular sleeves 44 and 45 respectively, with the ends of the spars 46 and 48 extending beyond the ends of the deck sleeves 44, 45 and being respectively received in and carried by the pairs of aligned bow and stern sleeves or openings 30 and 32, as shown in FIG. 3. The spars are normally made from aluminum tubular stock or tubes having a diameter of 2¼" and a length of 5'.

The flexible deck 41 is made from polyvinyl chloride dacron reinforced material and is approximately 5' square after the presewn sleeves are made to accommodate the spars. Such material has certain advantages over canvas or cloth since it will not rip or tear in the event a slit or cut is accidently placed therein. It should, of course, be appreciated that other types of plastic or cloth materials may be utilized as is known to persons skilled in the art. As another example, a fabric trampoline may be used.

Figure 7:
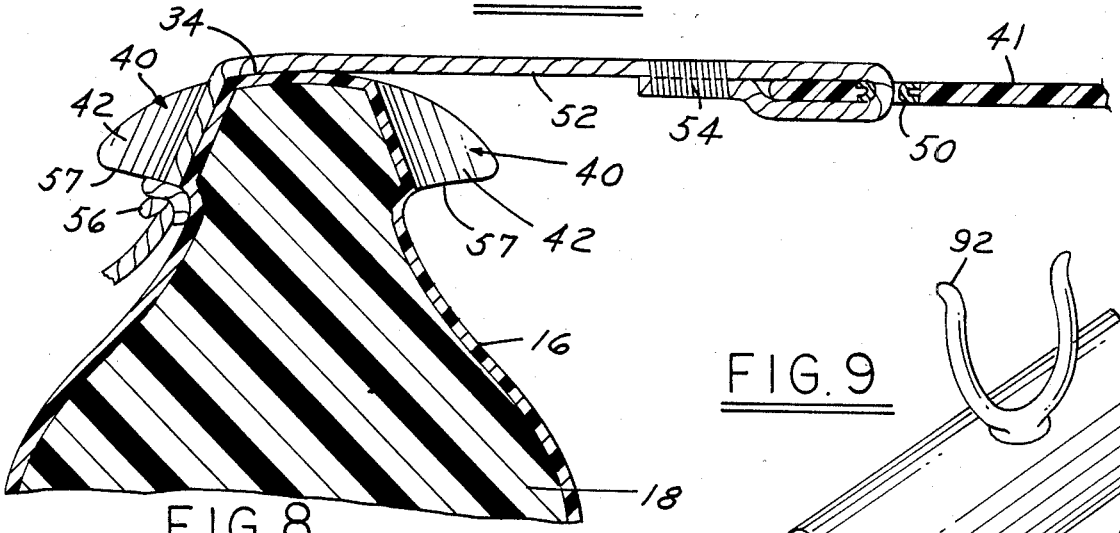
FIG. 7 is a fragmentary sectional view on an enlarged scale taken on the line 7—7 of FIG. 3.

The other pair of edges of the deck 41 are provided with eyelets 50 generally equal in number to the number of notches 40 provided along one of the edges of the rim 34 of the hull 12, 14. Each deck eyelet 50 is provided with a tension rope 52 having the inner end thereof extending through the eyelet 50 and turned back and secured to the rope 52 such as by sewing as indicated by the numeral 54 in FIG. 7. The tension ropes 52 are elastic and have at the other end thereof an enlarged head or knot 56 which is adapted to be received in and to be retained by the corresponding notch 40. Each tension rope 52 forms a removable tension means interposed between the eyelets 50 of the flexible deck 41 and the notches 40 provided on the top rims 34 of the hulls 12, 14. At the time of assembly, each elastic rope 52 is pulled over the rim or top surface of the corresponding hull and extends through the corresponding notch 40, with the knot 56 fitting under and engaging the under surfaces 57 of the notch as shown in FIG. 7.

Figure 8:
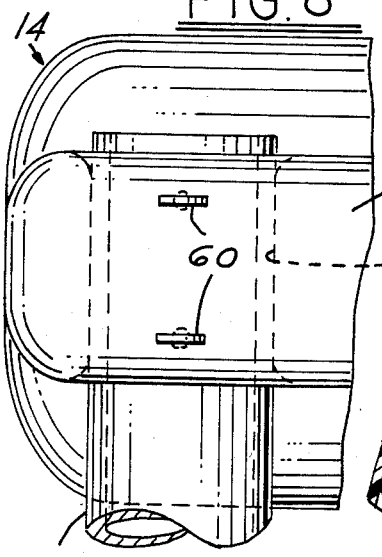
FIG. 8 is a fragmentary plan view illustrating the removable connections of the end of the spar to the bow or stern sleeves provided on the hulls.
Figure 9:
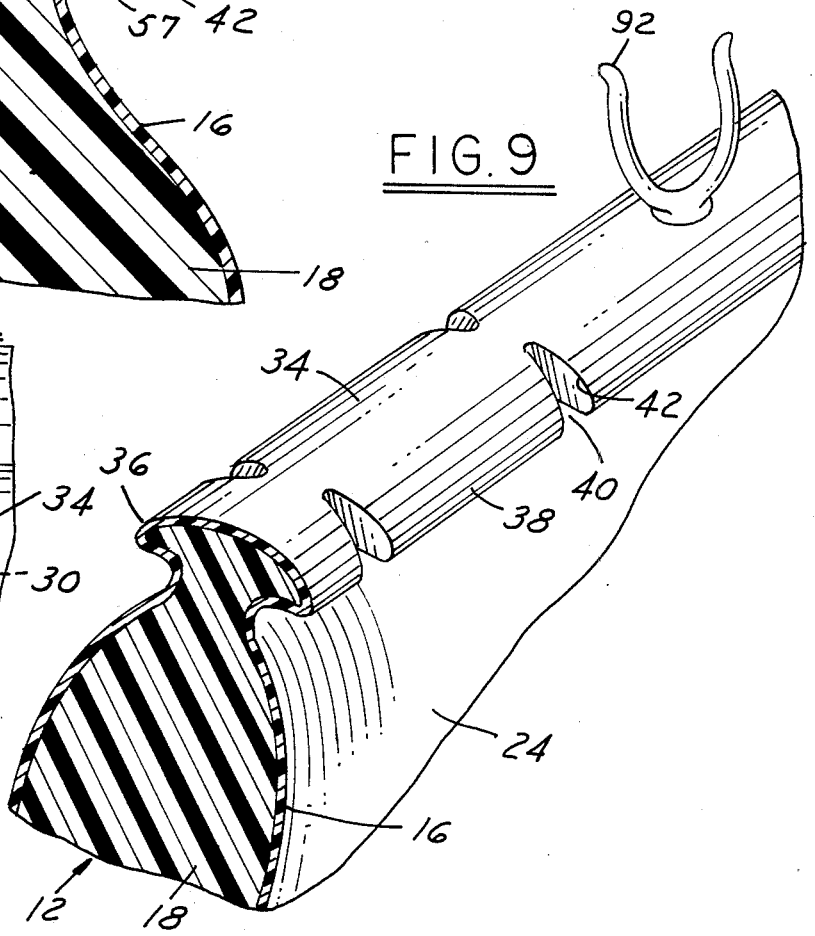
FIG. 9 is a fragmentary perspective view of the hull showing in particular the slots provided in the top surface thereof.

In order to retain the hulls 12, 14, deck 41 and spars 46 and 48 in assembled relationship, removable pin fastening means or quick release pins 60 are provided for each end of each spar 46, 48. The removable pin fastening means or pull pins 60, made from stainless steel, extend through the bow and stern sleeves and the ends of the spars 46, 48 to maintain the deck 41 and the hulls 12, 14 in assembled relationship. FIGS. 3 and 8 indicate that two removable pin means 60 are provided for each end of the spars 46, 48. It should of course be appreciated that a single pin 60 may be provided rather than two. The bow and stern sleeves 30, 32 and the skin 14 are provided with threaded recesses 62 which receive externally threaded metal bearings or inserts 64. Each bearing 64 has a pin opening 66 which is aligned with the pin opening 68 provided in the spar as shown in FIG. 5. The removable pin fastening means 60 has a generally cylindrical stem 70 and a ring shaped head 72.

As illustrated in the drawings and in particular to FIG. 6 thereof, the side surfaces 24 of each hull includes a pair of first side portions 80, 82 located generally below the water line 84. The first side portions or surfaces 80, 82 are straight and parallel. In addition, the side surfaces 24 include second side portions or surfaces 86, 88 located generally above the water line 64. The second side portions 86, 88 taper upwardly towards one another and terminate adjacent the top surface of the corresponding hull 12, 14. With such a construction, approximately ⅔ of the height of each hull rides above the water level 84 due to the buoyancy of the rowboat 10 as best illustrated in FIGS. 2 and 6.

The top surface or rim 34 of each hull is provided with a pair of generally cylindrical and vertically spaced apart oar lock openings, tubular sockets or receptacles 90 which are molded into the hull during the manufacture thereof. An oar lock 92 is provided in one or the other of the sockets 90 to position and to retain the oars 94 of the rowboat 10 as illustrated in the drawings. Each oar lock 92 has a stern, not shown, which extends into the corresponding socket 90. The oar lock 92 may be either fixedly or removably retained in the socket 90. If the oar lock 92 is removable, it may be moved to the second socket 90 to accommodate the user as is known in the art.

The hulls 12, 14 may be used interchangably at either side of the rowboat 10 and to accommodate such use, the notches 40 are provided along both longitudinal edges 36, 38 of the hull 12, 14.

In use, the operator slips the spars 46, 48 through the sleeves 44, 45 of the flexible deck 41. The ends of the spars are then slid into the aligned openings or sleeves 30, 32 provided in the hulls 12, 14. Thereafter the quick release pins 60 are inserted through the sleeves and spars as shown in FIG. 5. The elastic tension ropes 52 are extended over the top surface of the corresponding hull and retained in the notches 40 by the engagement of the enlarged heads 56 with the surfaces 57 as shown in FIG. 7. As a result thereof, a catamaran type rowboat 10 is assembled having dimensions of approximately 5′ in width and 6′ in length.

The operator sits on the flexible deck 41 and utilizes the oars 94 to manuver the rowboat in a conventional manner.

The operator can quickly disassemble the water craft 10 by removing the tension ropes 52 from the notches 40; removing the quick release pins 60; rolling up the flexible deck with the spars remaining therein or after having removed the spars 46, 48 from the deck sleeves 44, 45; and finally storing the components for storage or transportation as noted previously. A single skilled operator or person can assemble or disassemble the rowboat in about thirty seconds or less.

Having described my invention, reference should now be made to the following claims:

1. A twin hull disassemblable rowboat comprising:

(a) a pair of generally identical elongated unitary buoyant hulls made from plastic material, said hulls being arranged and spaced side by side in parallel relation;

(b) said hulls each having a bottom surface, a top surface and a pair of side surfaces;

(c) said top surface having a pair of longitudinal edges and a series of longitudinally spaced notches;

(d) a pair of tubular sleeves on each hull adjacent to the bow and stern, with the bow sleeve in one hull being transversely aligned with the bow sleeve in the other hull and the stern sleeve in one hull being transversly aligned with the stern sleeve in the other hull;

(e) a flexible deck spanning the space between said hulls and having at one pair of edges elongated tubular sleeves and at the other pair of edges a plurality of longitudinally spaced fastening eyelets corresponding generally to and aligned with the notches in the opposing hull;

(f) a pair of elongated spars extending through the corresponding deck sleeves, with the ends thereof extending beyond said deck sleeves and being respectively received in and carried by said pairs of aligned bow and stern sleeves;

(g) removable tension means interposed between the eyelets of said flexible deck and said notches on the top surfaces of said hulls; and (h) removable pin fastening means extending through said bow and stern sleeves and the ends of said spars to maintain said deck and said hulls in assembled relation.

2. The twin hull disassemblable rowboat defined in claim 1 wherein each hull has a tough outer skin made from a suitable plastic material, with the interior of each hull being solid and made from a foam plastic material.

3. The twin hull disassemblable rowboat defined in claim 2 wherein said outer skin is polyethylene and said foam plastic material is polyurethane foam.

4. The twin hull disassemblable rowboat defined in claim 3 wherein each hull has an outer skin of approximately 3/16″ thick and dimensions of 6′ in length, 2′ in height and 1′ in width.

5. The twin hull disassemblable rowboat defined in claim 1 wherein said flexible deck is made from a polyvinyl chloride, dacron reinforced material.

6. The twin hull disassemblable rowboat defined in claim 1 wherein said bottom surface of each hull in elevation has a generally curved configuration from the bow to the stern.

7. The twin hull disassemblable rowboat defined in claim 1 wherein the notches in the top surface of each hull are spaced longitudinally along each of the longitudinal edges thereof, said notches having axes which extend generally perpendicular to the longitudinal axis of the hull.

8. The twin hull disassemblable rowboat defined in claim 1 wherein the side surfaces of each hull includes first side portions located generally below the water line which are straight and parallel and further includes second side portions generally above the water line which taper upwardly towards one another and terminate adjacent the top surface.

9. The twin hull disassemblable rowboat defined in claim 1 wherein said flexible deck is of generally rectangular configuration in plan.

10. The twin hull disassemblable rowboat defined in claim 1 wherein the end of each spar is connected to the corresponding stern or bow sleeve by a pair of removable quick release pins which extend through said bow or stern sleeve and the corresponding end of said spar to maintain said deck and said hulls in assembled relation.

11. The twin hull disassemblable rowboat defined in claim 1 wherein each hull is provided in the top surface thereof with one or more sockets, each of which is adapted to receive the stem of an oar lock.

12. The twin hull disassemblable rowboat defined in claim 11 wherein a pair of tubular sockets are provided in the top surface of each hull and are designed to selectively receive the stem of an oar lock.

13. The twin hull disassemblable rowboat defined in claim 12 wherein said elongated spars are tubular and made from aluminum.

14. The twin hull disassemblable rowboat defined in claim 1 wherein approximately ⅔ of the height of the hulls ride above the water level due to the buoyancy of the rowboat.

15. The twin hull disassemblable rowboat defined in claim 1 wherein said tubular sleeves at the bow and stern are molded into the hulls at the time of manufacture.

16. A twin hull disassemblable rowboat defined in claim 1 wherein the removable tension means are in the form of a plurality of tension ropes, each rope at one end thereof being fixedly secured to an eyelet, with the other end of the rope having an enlarged knot or head formed thereon, with the rope adapted to fit over the top surface of the hull and extend through the corresponding notch, with the knot fitting under and engaging the under surface of the notch.

17. A hull for a catamaran type water craft:

(a) a unitary elongated buoyant body having a longitudinal axis, said body being made from plastic material and having a generally smooth and tough outer skin surrounding a foam plastic inner core;

(b) said body having a bottom surface, top surface and a pair of side surfaces;

(c) said bottom surface in elevation having a generally curved configuration from the bow to the stern;

(d) the side surfaces including first side portions in the part of the body below the water line which are parallel and second side portions generally above the water line which are inclined upwardly towards one another and terminate adjacent said top surface: and (d) said top surface having a pair of longitudinal edges and a series of longitudinally spaced notches along each of the longitudinal edges thereof, said notches having axes which extend generally perpendicular to the longitudinal axis of the body, each notch being adapted to catch a knot at the end of a line.

18. The hull defined in claim 17 wherein said outer skin is polyethylene and said foam plastic material is polyurethane foam.

19. The hull defined in claim 18 wherein said body has an outer skin of approximately 3/16" thick and dimensions of 6' in length, 2' in height and 1' in width.

20. The hull defined in claim 17 wherein the top surface of said body is provided with one or more sockets, each of which is adapted to receive the stem of an oar lock.

21. The hull defined in claim 17 wherein approximately ⅔ of the height of the hull ride above the water level due to the buoyancy thereof.

22. The hull defined in claim 17 wherein a pair of tubular sleeves are located at the bow and stern of said body, said sleeves being molded into the body at the time of manufacture.

23. A twin hull disassemblable water craft of the catamaran type comprising:

(a) a pair of generally identical elongated unitary buoyant hulls made from plastic material, said hulls being arranged and spaced side by side in parallel relation;

(b) said hulls each having a bottom surface, a top surface and a pair of side surfaces;

(c) said bottom surface in elevation having a generally curved configuration from the bow to the stern;

(d) said top surface having a pair of longitudinal edges and a series of longitudinally spaced notches having axes which extend generally perpendicular to the longitudinal axis of the hull;

(e) the side surfaces including first side portions located generally below the water line which are straight and parallel and second side portions generally above the water line which taper upwardly towards one another and terminate adjacent said top surface;

(f) a pair of tubular sleeves on each hull adjacent the bow and stern, with the bow sleeve in one hull being transversely aligned with the bow sleeve in the other hull and the stern sleeve in one hull being transversely aligned with the stern sleeve in the other hull;

(g) a flexible deck spanning the space betwen said hulls, said deck being of generally rectangular configuration in plan, said deck having at one pair of parallel edges elongated tubular sleeve and at the other pair of parallel edges a plurality of longitudinally spaced fastening eyelets corresponding generally to and aligned with the notches in the opposing hull;

(h) a pair of elongated spars extending through the corresponding deck sleeves, with the ends thereof extending beyond said deck sleeves and being respectively received in and carried by said pairs of aligned bow and stern sleeves;

(i) removable tension means interposed between the eyelets of said flexible deck and said notches on the top surface of said hulls; and (j) removable pin fastening means extending through said bow and stern sleeves and the ends of said spars to maintain said deck and said hulls in assembled relation.

24. The twin hull disassemblable water craft defined in claim 23 wherein each hull has a tough outer skin made from a suitable plastic material, with the interior of each hull being solid and made from a foam plastic material.

25. The twin hull disassemblable water craft defined in claim 24 wherein said outer skin is polyethylene and said foam plastic material is polyurethane foam.

26. The twin hull disassemblable water craft defined in claim 25 wherein said flexible deck is made from a polyvinyl chloride, dacron reinforced material.

27. The twin hull disassemblable water craft defined in claim 25 wherein the notches in the top surface of each hull are spaced longitudinally along each of the longitudinal edges thereof, said notches having axes which extend generally perpendicular to the longitudinal axis of the hull.

28. The twin hull disassemblable water craft defined in claim 23 wherein the end of each spar is connected to the corresponding stern or bow sleeve by a pair of removable quick release pins which extend through said bow or stern sleeve and the corresponding end of said spar to maintain said deck and said hulls in assembled relation.

29. The twin hull disassemblable water craft defined in claim 23 wherein approximately $\frac{2}{3}$ of the height of the hulls ride above the water level due to the buoyancy of the rowboat;

said tubular sleeves at the bow and stern are molded into the hulls at the time of manufacture; and wherein the removable tension means are in the form of a plurality of tension ropes, each rope at one end thereof being fixedly secured to an eyelet, with the other end of the rope having an enlarged knot or head formed thereon, with the rope adapted to fit over the top surface of the hulls and extend through the corresponding notch, with the knot fitting under and engaging the under surfaces of the notch.

* * * * *